US010273921B2

(12) United States Patent
McCrindle

(10) Patent No.: US 10,273,921 B2
(45) Date of Patent: Apr. 30, 2019

(54) HIGH PRESSURE PUMP

(71) Applicant: DELPHI TECHNOLOGIES IP LIMITED, St. Michael (BB)

(72) Inventor: Christopher J. McCrindle, Gillingham (DE)

(73) Assignee: DELPHI TECHNOLOGIES IP LIMITED (BB)

( * ) Notice: Subject to any disclaimer, the term of this patent is extended or adjusted under 35 U.S.C. 154(b) by 218 days.

(21) Appl. No.: 15/104,774

(22) PCT Filed: Oct. 20, 2014

(86) PCT No.: PCT/EP2014/072403

§ 371 (c)(1),
(2) Date: Jun. 15, 2016

(87) PCT Pub. No.: WO2015/090676

PCT Pub. Date: Jun. 25, 2015

(65) Prior Publication Data

US 2016/0377042 A1 Dec. 29, 2016

(30) Foreign Application Priority Data

Dec. 17, 2013 (GB) ..... 1322264.1

(51) Int. Cl.
*F04B 53/00* (2006.01)
*F02M 59/44* (2006.01)
(Continued)

(52) U.S. Cl.
CPC ..... *F02M 59/442* (2013.01); *F02M 59/027* (2013.01); *F02M 59/102* (2013.01);
(Continued)

(58) Field of Classification Search
CPC ..... F04B 9/042; F04B 53/007; F04B 1/0408; F04B 1/0413; F04B 53/008; F04B 19/22;
(Continued)

(56) References Cited

U.S. PATENT DOCUMENTS 6,763,808 B2 * 7/2004 Ryuzaki ..... F02M 59/08 123/446
2011/0209687 A1 * 9/2011 Schroeder ..... F02M 63/005 123/459
2012/0195778 A1 8/2012 Koga et al.

FOREIGN PATENT DOCUMENTS

DE 10322598 A1 12/2004
DE 102008002169 A1 12/2009
(Continued)

*Primary Examiner* — Michael Leslie
*Assistant Examiner* — Abiy Teka
(74) *Attorney, Agent, or Firm* — Joshua M. Haines

(57) ABSTRACT

A fuel pump unit includes a pump head provided with an axial blind bore within which is arranged a piston extending from an inner end, inside the bore, to an outer end, outside the head, the outer end cooperating with a cam follower and a cam of which rotations reciprocally displace the piston. The pump unit also includes a coil spring axially compressed between pump head and the cam follower and a tubular turret assembly extending toward the cam and provided with a through bore through which extends the piston, the final spirals of the spring being slipped around the outer surface of the turret. The turret is an added part, non-integral to the pump head and, arranged in abutment against an under face of the pump head, the blind bore being coaxial to the through bore arranged in the turret.

6 Claims, 1 Drawing Sheet

(51) Int. Cl.

| | |
|---|---|
| ***F02M 59/48*** | (2006.01) |
| ***F02M 59/02*** | (2006.01) |
| ***F02M 59/10*** | (2006.01) |
| ***F04B 1/04*** | (2006.01) |
| ***F04B 9/04*** | (2006.01) |
| ***F04B 19/22*** | (2006.01) |

(52) U.S. Cl.
CPC ..... *F02M 59/48* (2013.01); *F04B 1/0408* (2013.01); *F04B 1/0413* (2013.01); *F04B 9/042* (2013.01); *F04B 19/22* (2013.01); *F04B 53/007* (2013.01); *F04B 53/008* (2013.01); *F05B 2210/11* (2013.01); *F05B 2240/14* (2013.01)

(58) Field of Classification Search
CPC ..... F02M 63/0225; F02M 59/442; F02M 59/027; F02M 59/102; F02M 59/48
See application file for complete search history.

(56) References Cited

FOREIGN PATENT DOCUMENTS

| | | | |
|---|---|---|---|
| DE | 102008043217 | A1 | 4/2010 |
| EP | 2273115 | A1 | 1/2011 |
| GB | 2288852 | A1 | 11/1995 |
| JP | 2007321613 | A1 | 12/2007 |
| JP | 2012202375 | A1 | 10/2012 |

* cited by examiner

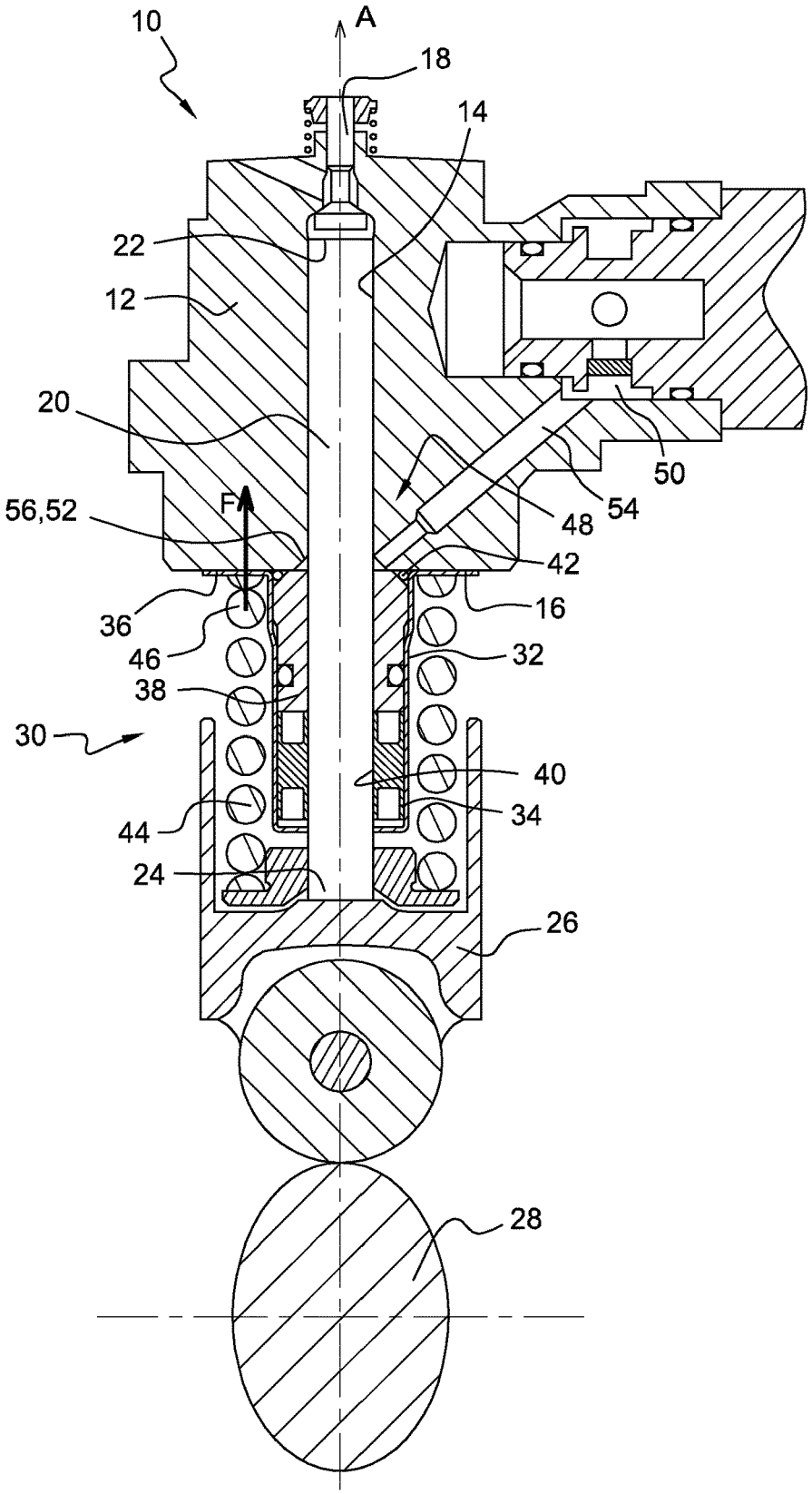
10
A
18
14
22
12
20
50
54
48
56,52
F
42
16
36
46
32
38
30
40
34
44
24
26
28

HIGH PRESSURE PUMP

CROSS REFERENCE TO RELATED APPLICATIONS

This application is a national stage application under 35 USC 371 of PCT Application No. PCT/EP2014/072403 having an international filing date of Oct. 20, 2014, which is designated in the United States and which claimed the benefit of GB Patent Application No. 1322264.1 filed on Dec. 17, 2013, the entire disclosures of each are hereby incorporated by reference in their entirety.

TECHNICAL FIELD

The present invention relates to a high pressure fuel pump and more particularly to a turret assembly external to the pump head and arranged around the piston of the pump.

BACKGROUND OF THE INVENTION

High pressure fuel pump units typically comprise a pump head having an internal blind bore within which is arranged a piston reciprocally displacing. The pump head is provided with a turret member extending outwardly from the head and surrounding the bore. A coil spring compressed between a cam follower and the pump head is axially maintained on the turret. As the high pressure fuel leaks between the piston and the bore, even if the clearance is of microns, on oil lubricated pumps to prevent any mixing of fuel with oil into the cambox, the pump head is further provided with a return fuel gallery comprising an annular groove and a return channel extending from said groove.

A first problem is that the guiding bore is lengthy extending in the pump head and through the turret and, the very precise machining of the bore is difficult. Currently a typical clearance utilized ranges from 4.5 to 6.5 μm. A further problem is that the annular groove also requires difficult and costly machining.

SUMMARY OF THE INVENTION

Accordingly, it is an object of the present invention to provide a fuel pump unit having a pump head provided with an axial blind bore within which is arranged a piston extending from an inner end, inside the bore, to an outer end, outside the head. The outer end cooperates with a cam follower and a cam that rotates reciprocally displacing the piston. The pump unit further comprises a coil spring axially compressed between pump head and the cam follower and a tubular turret assembly extending toward the cam and provided with a through bore through which extends the piston. The final spirals of the spring are slipped around the outer surface of the turret. Advantageously, the turret is an added part, non-integral to the pump head and, arranged in abutment against an under face of the pump head. The blind bore is coaxial to the through bore arranged in the turret. Thanks to this arrangement the clearance between the bore and the piston can be reduced to 2.5 μm.

The turret assembly comprises an inner tubular sleeve arranged in a retainer, the retainer having a cup-like portion wherein is received the sleeve and, a disc face radially outwardly extending from the cup-like portion and arranged in abutment against the under face of the pump head.

The spring is engaged around the external surface of the retainer, the disc face being caught between the pump head and coil spring.

The pump unit is further provided with a fuel return line in which flows fuel leaking between the bore and the piston. The return line is in fluid communication with a low pressure line.

Also, the bore in the under face of the pump head is provided with a counter-shape geometry, countersink or counterbore, for instance or a 45° chamfer or an annular shoulder, so that when the turret is in place the countersink defines an annular collection groove around the piston, said groove being part of the return line.

The pump unit is further provided with a return channel extending through the pump head from the collection groove to the low pressure line.

BRIEF DESCRIPTION OF THE DRAWING

The present invention is now described by way of example with reference to the accompanying FIG. 1 which is a section of a unit pump as per the invention.

DESCRIPTION OF THE PREFERRED EMBODIMENTS

FIG. 1 represents a high pressure fuel unit pump 10 of fuel injection equipment. The unit pump 10 comprises a head 12 provided with a blind bore 14 axially extending along a main axis A and opening in an under face 16 of the pump head 12.

For clarity purposes this description will utilize the orientation of FIG. 1. Thus words and expressions such as "top, bottom, under, over, superior, inferior . . . " may be utilized without any intention to limit the scope of the invention.

A poppet valve 18, arranged at the top of the bore 14, controls a fuel inlet into the bore 14. A piston 20, slidably arranged in the bore 14, extends from an inner end 22 inside the pump head 12 to an outer end 24 which cooperates with a cam follower 26 and a cam 28. The rotations of the cam 28 actuate the piston 20 in reciprocal axial A displacements inside the bore 14.

The pump unit 10 is further provided with a turret assembly 30 comprising a retainer 32 that has a cup-like 34 portion holed at its bottom and a radially outwardly extending disc face 36 and, a cylindrical sleeve 38, provided with an axial through bore 40, the sleeve 38 being arranged inside the cup-like portion 34. The diameter of the through bore 40 is similar to the diameter of the bore 14 in the pump head 12, adjusted to the piston diameter and enabling relative sliding. The blind bore 14 being of shorter axial length than is the prior art, the diametral clearance between piston 20 and the bore 14, or between the piston 20 and the through bore 40, can be reduced and as a tighter fit improves sealing this represents a major benefit of this invention.

Many alternatives can be chosen for the material of the sleeve 38 such as steel or plastic material.

As presented on the FIGURE, the turret assembly 30 is positioned against the under face 16 of the pump head 12, the through bore 40 being coaxial A to the blind bore 14 of the pump head 12 and the piston 20 extending through both bores 14, 40.

To ensure a leak-free assembly, the turret 30 is further provided with sealing means 42. On the embodiment presented, two O-rings are represented but many other alternatives can be chosen. An upper seal 42 is arranged between the sleeve 38 and the pump head 12 while a lower seal is at the bottom of the cup-like portion 34 between the sleeve 38 and said cup-like portion 34.

A coil spring 44 axially arranged around the piston 20 is compressed between the cam follower 26 and the disc face 36, the final upper spirals 46 of the spring 44 being engaged around the cup-like portion 34 so the compression spring 44 generates on the disc face 36 an axially upwardly oriented force F.

In the pump unit 10, the turret 30 can be fixed to the pump head 12 but, it can as well be just maintained in abutment against the under face 16 of the pump head 12 thanks to the upward force F of the spring 44.

It is known that the rotation of the cam 28 generates undesired minor radial movement of the lower part of the piston 20 so, in the latter case of an un-fixed/just maintained turret 30, the turret assembly 30, or the sleeve 38 inside the retainer 32, may self-center in accompanying these minor radial displacements.

In a non-represented alternative the turret 30 can be a single part integrating the retainer and the sleeve.

In operation the high pressure fuel compressed in the pump head 12 by the piston 20 leaks between the piston 20 and the bore 14. To avoid mixing fuel with oil that lubricates the cam area, the pump unit 10 is provided with a return line 48 that captures the leaking fuel and sends it back to a low pressure line 50 or to the pump inlet or to the fuel return line. The return line 48 comprises an annular collection groove 52 surrounding the bore 14 and at least one channel 54 extending inside the pump head 12 from the collection groove 52 to the low pressure line 50.

The fuel leaking gets to the annular groove 52 where its pressure drops as the groove 52 is a large volume compared to the clearance between the piston and the bore 14. From the groove 52 the fuel, now at low pressure, flows into the channel 54 to finally get to the low pressure line 50.

At the opening of the bore 14 in the under face 16 of the pump head 12 is provided with a countersink 56 that enlarges the final portion of the bore 14. On the FIGURE the countersink 56 is a 45° chamfer but any other counter-shape geometry or enlargement area such as a counterbore or a square shoulder could be made. On the embodiment presented on the FIGURE, the channel 54 extends from said chamfer 56 to the low pressure line 50.

Once in place in the pump unit 10, the disc face 36 of the turret assembly 30 closes the countersink 56 forming the collection grove 52.

The following list of references is utilized in this description:

A main axis
F force
10 pump unit
12 pump head
14 bore
16 under face of the pump head
18 poppet valve
20 piston
22 top end of the piston
24 lower end of the piston
26 cam follower
28 cam
30 turret assembly
32 retainer
34 cup-like portion
36 disc face
38 sleeve
40 through bore
42 seal
44 coil spring
46 final upper spirals
48 return line
50 low pressure line
52 annular groove
54 channel
56 countersink

The invention claimed is:

1. A fuel pump unit comprising:

a pump head provided with an axial blind bore within which is arranged a piston extending from an inner end, inside the blind bore, to an outer end, outside the pump head, the outer end cooperating with a cam follower and a cam which rotates and reciprocally displaces the piston;

a coil spring axially compressed between the pump head and the cam follower and, a tubular turret assembly extending toward the cam and provided with a through bore through which extends the piston, a final spiral of the coil spring being slipped around an outer surface of the turret assembly;

wherein the turret assembly is an added part, non-integral to the pump head and, arranged in abutment against an under face of the pump head, the blind bore being coaxial to the through bore arranged in the turret assembly, the turret assembly being unfixed such that the turret assembly self-centers to accompany radial displacements of the piston.

2. A pump unit as set in claim 1 claim wherein the turret assembly comprises an inner tubular sleeve arranged in a retainer, the retainer having a cup portion wherein is received the inner tubular sleeve and, a disc face radially outwardly extending from the cup portion and arranged in abutment against the under face of the pump head.

3. A pump unit as set in claim 2 wherein the coil spring is arranged around the retainer, the disc face being caught between the pump head and the coil spring.

4. A pump unit as set in claim 1 further comprising a fuel return line in which flows fuel leaking between the blind bore and the piston, the fuel return line being in fluid communication with a low pressure line.

5. A pump unit as set in claim 4 wherein an opening of the blind bore in the under face of the pump head is provided with a counter-shape geometry which defines an annular collection groove around the piston, the annular collection groove being part of the fuel return line.

6. A pump unit as set in claim 5 further comprising a return channel extending through the pump head from the annular collection groove to the low pressure line.

* * * * *